United States Patent [19]

Willoughby

[11] Patent Number: 4,536,924

[45] Date of Patent: Aug. 27, 1985

[54] ONE PIECE CLAMPING DEVICE

[76] Inventor: Patrick Willoughby, 712 Elberon Ave., Dayton, Ohio 45403

[21] Appl. No.: 586,267

[22] Filed: Mar. 5, 1984

[51] Int. Cl.[3] ..... A44B 9/10; G09F 3/08

[52] U.S. Cl. ..... 24/487; 24/543; 24/545; 24/563; 24/157; 40/20 R

[58] Field of Search ..... 24/543, 544, 545, 563, 24/487, 156 R, 157 R, 160, 161, 150 R; 40/20 R

[56] References Cited

U.S. PATENT DOCUMENTS

| | | | |
|---|---|---|---|
| D. 234,204 | 1/1975 | Miller et al. | 24/487 |
| 3,093,874 | 6/1963 | Rapata | 24/297 |
| 3,149,386 | 9/1964 | Trundy | 24/157 R |
| 3,524,230 | 8/1970 | Hankel | 24/157 R |
| 3,713,622 | 1/1973 | Dinger | 24/543 |
| 3,729,780 | 5/1973 | White | 24/156 R |
| 3,824,654 | 7/1974 | Takabayashi | 24/487 |
| 3,825,012 | 7/1974 | Nicoll | 24/543 |
| 3,854,482 | 12/1974 | Laugherty et al. | 24/543 |
| 3,906,592 | 9/1975 | Sakasegawa et al. | 248/74.5 |
| 3,978,555 | 9/1976 | Weisenthal | 24/543 |
| 4,096,655 | 6/1978 | Ullman, Jr. | 40/20 R |
| 4,212,303 | 7/1980 | Nolan | 24/543 |
| 4,247,076 | 1/1981 | Larkin | 24/487 |
| 4,344,240 | 8/1982 | Schiller | 40/20 R |

FOREIGN PATENT DOCUMENTS

| | | | |
|---|---|---|---|
| 240118 | 8/1962 | Australia | 24/297 |
| 1220673 | 7/1966 | Fed. Rep. of Germany | 24/297 |

*Primary Examiner*—Victor N. Sakran

*Attorney, Agent, or Firm*—Joseph Patrick Burke

[57] ABSTRACT

A one piece clamping device which includes a proximal flexible hinge portion, distal portions having non-penetrating substantially flat gripping surfaces, and male and female medial portions. The male medial portion has a male locking member, one surface of which is toothed and the other surface of which is non-toothed. The female medial portion has a female locking cavity and a locking ledge extending therein. The toothed surface of the male locking member thereby meshes with the locking ledges of the female cavity. The male medial portion also includes a male guide, and the female medial portion also include a female guide channel for receiving the guide and a spur to guide the non-toothed surface of the male locking member into position in the female cavity and to retain it.

8 Claims, 12 Drawing Figures

FIG-1
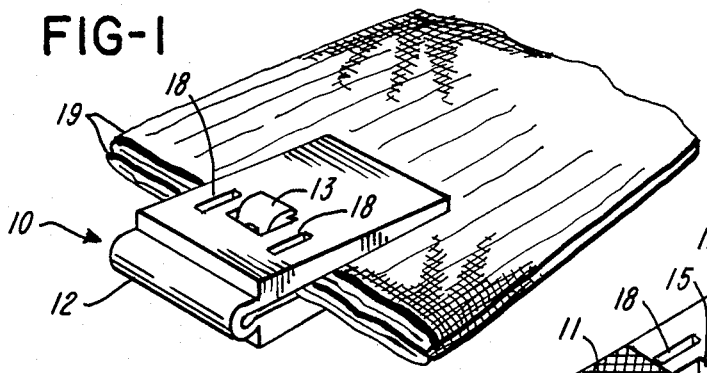
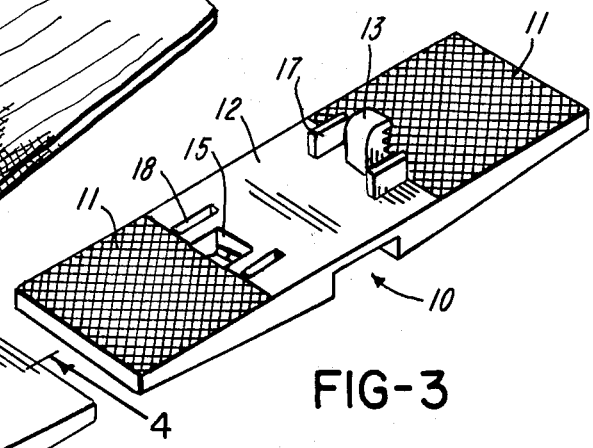
FIG-3
FIG-2
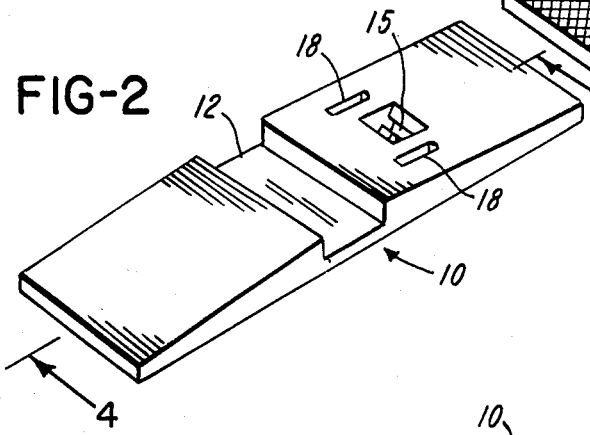
FIG-4
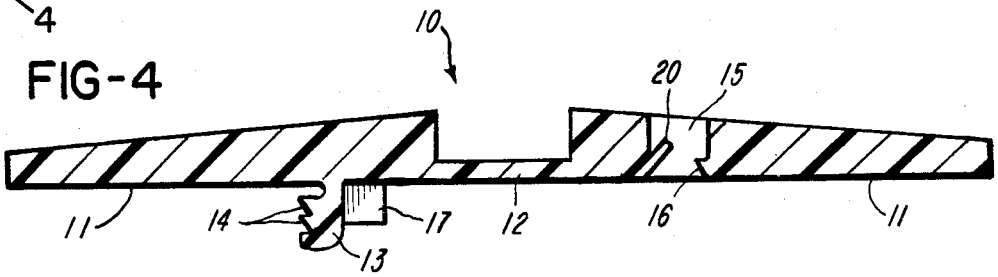
FIG-5
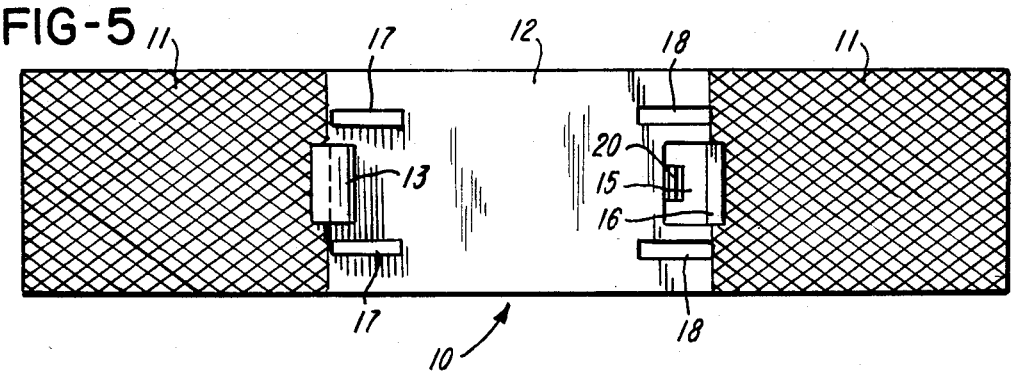

ONE PIECE CLAMPING DEVICE

The present invention is directed to a unitary (one piece) clamping device capable of holding together paired articles of clothing, e.g., socks or hose, without piercing, stretching or distorting the fabric or material from which the clothing is made. The present device enables the matched pair of clothing articles to be held together during washing, drying and afterwards thereby eliminating the need to sort and roll pairs of such clothing items as socks and hosiery after laundering. Additionally the ability to retain the matched pair of clothing items together without puncturing or distorting the fabric or material from which the articles are made satisfies a need which has long existed in the art.

The unitary construction provided by this invention enables the clamping device to be molded in one piece using relatively inexpensive plastic materials without sacrificing the positive gripping feature provided by opposed substantially flat surfaces. The features of the present invention enable use by the blind and color-blind with ease and confidence that the articles they are wearing are indeed of the matched color desired.

BACKGROUND OF THE INVENTION AND PRIOR ART

Anyone who has struggled with the problem of keeping matched articles of clothing, such as socks and hosiery, together during washing and drying recognizes that attachment devices are useful for this purpose. It seems in some instances that washing machines and dryers virtually consume such small articles of clothing as socks preventing their pairing after cleaning. Also it is desirable to keep such matched pairs of clothing with similar or identical markings together so that they will not be lost or difficult to find at the end of the drying cycle since loss of one such article of a matched pair renders the other one all but useless to the wearer.

However, many of the attachment devices provided heretofore have involved penetration of the fabric, or material from which the clothing is made, causing damage thereto. Other devices, while not actually penetrating the fabric, do stetch it or distort it in some other way.

One proposed solution to the lost articles of clothing has been to place ssmall articles like socks or hosiery in a hose bag of foraminous nature so that they will be kept together during the washing and drying cycles. Net bags have been used for this purpose. Such bags permit co-mingling of the individual members of pairs and suffer from the further disadvantage that the access to the soap and the cleansing action afforded by washing a matched pair of socks together is lost due to the tendency to place a larger number of pairs of hose in such bag than will accommodate thorough cleaning. Additionally the use of such net bags still presents the user with the problem of sorting and matching after the drying cycle has been finished. Thus net bags are not particularly useful to the person who is sightless, or color-blind or otherwise has impaired eyesight.

In certain cases, for example, where the cclothing is to be washed and dried at public laundromats, it is desirable to be able to identify clothing as to its owner. One of the commonest ways of identifying such clothing has been by sewing labels to an inside surface of the garment which does not appear when it is worn. The maneuver is time consuming and still does not serve the needs of providing identification for those having impaired vision.

Hence the provision of inexpensive means to keep the matched articles of clothing together during washing and drying cycles when they are subjected to vigorous tossing and rolling motions and providing a means of identification which can be used by persons having impaired vision while at the same time avoiding puncturing and distoring the fabric, or other material from which the garments are made, has long been desired.

Indeed one of the advantageous features of the present invention is that it can be used for a wide variety of clothing items and is not limited to use with socks or hosiery. For example, since the device of this invention does not penetrate or distort the fabric on which it is clamped, it can be used in place of a clothespin to hang clothes on a line to dry. Also by making the hinged portion of the device sufficiently long, the device of this invention can be used to hang trousers, skirts, etc., by looping it over a hanging bar. One advantage to the use of the device of this invention in hanging trousers is that by hanging them with the leg portion up, it tends to maintain the crease in the trousers.

Typical of the prior art patents which penetrate completely through the fabric or other material from which the garment is made are U.S. Pat. No. 3,149,386 to A. S. Trundy, U.S. Pat. No. 3,524,230 to J. P. Hankel and U.S. Pat. No. 3,729,780 to Robert L. White.

The Trundy patent is directed to a fabric fastening device having pins 16 and 18 which assume a mating position with regard to relieved bosses 20 and 22 to engage same with the fabric pinned therebetween. Upper arm 10 which is hinged at 12 to lower arm 14 completes the fastener assembly with the aforementioned pin passing through the fabric thus securing the fabric to the fastener.

The White patent illustrates a hinged clamp having discs carried at opposed ends whereby one of the said discs carries a projecting, pointed penetrating shaft 18 which engages through a sleeve 26 so that the shaft 18 penetrates through the fabric and its head (end portion) 20 passes through the sleeve 26 allowing the projections 22 on said head to be locked on the annular rim at the flange 28 provided for this purpose.

The Hankel patent features a pair of spaced parallel prongs or pins 14 having cloth penetrating ends 15 including a conical tip or point 16 which penetrates through abutting portions 29 of members 30 to lock the overlap layers of the diaper cloth in position.

Again it is a common feature of the White, Hankel and Trundy patents that one or more members of the clamping device actually penetrate and pierce through the fabric. Such a feature is undesirable and can be avoided in accordance with the device of the present invention.

U.S. Pat. No. 4,344,240 to Karl H. Schiller is directed to an identification snap for attachment to woven material and is comprised of two separate detachable members, one being a first plate member having an identifying indicia on its outer surface and a post projecting from an inner surface and a second plate member having an opening. The fabric is placed between these two post members and the first post member is pushed so that the fabric is either penetrated or wedged between the bulbous tip of the post member having indicia and the doughnut-shaped second plate. Although it is stated in the Schiller patent that the bulbous tip prevents fabric damage, it is clear that this tip and the "interference fit"

manner of operation of the Schiller identification snap would either penetrate the fabric or cause the distortion of same by stretching it. Clearly the use of the Schiller device would not seem applicable to other than woven fabrics and would be of dubious utility to certain woven fabrics such as are employed in trousers, skirts and the like.

U.S. Pat. No. 4,096,655 issued to Myron E. Ullman, Jr. is directed to a device particularly useful to the blind and colorblind for sorting fabrics, such as socks. The device utilizes a plurality of tabs connected by hinge springs to a frame. In use the fabric is slipped between the tab and the frame. The tab is then pushed through the aperture in the frame forcing the fabric through the aperture before it. The tab is then biased by the hinge springs against the frame securing the tag to the article of clothing. It will be apparent from inspection of the drawing figures of the Ullman, Jr. patent, particularly FIGS. 1 through 4 that the forcing of the tab 11 through a fold of the fabric would inherently create stretching at the point of contact with the tab end 11*a*. Such a distortion of fabric is avoided by the use of the present invention.

It will be observed that a feature common to each of the above-noted prior art patents is that the fabrics sought to be clamped are held between the clamping members which penetrate or distort (e.g., stretch) the fabric. This is avoided in accordance with this invention because the clamping members of the present device grip and compress but do not penetrate or stretch the fabric of the articles being clamped.

BRIEF DESCRIPTION OF THE DRAWINGS

FIG. 1 is a perspective view of the clamp of this invention attached to a pair of hose;

FIG. 2 is a perspective view of the upper or non-fabric engaging side of the clamp of this invention;

FIG. 3 is a perspective view of the bottom or fabric-engaging side of the clamp;

FIG. 4 is a cross-sectional view of the clamp of FIG. 2 taken along the line 4—4;

FIG. 5 is a bottom plan view of the clamp;

DETAILED DESCRIPTION OF THE INVENTION

Figure 6:
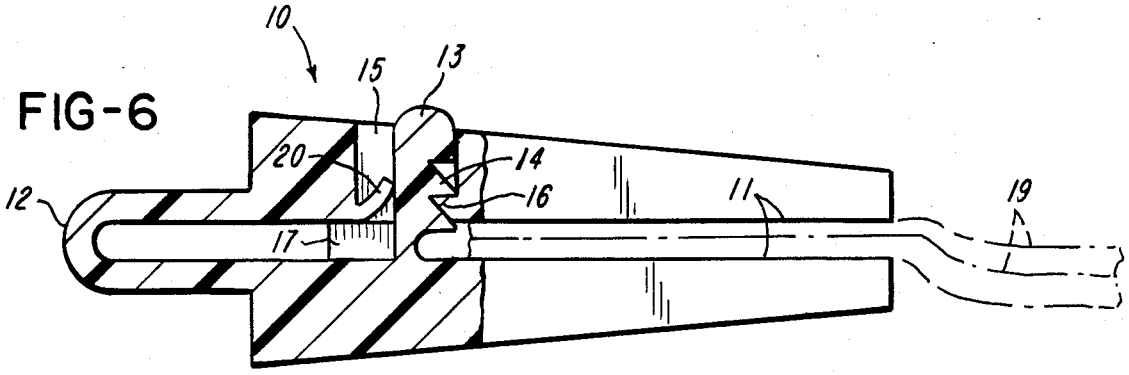
FIGS. 6 and 7 are cross-sectional views of the clamp of this invention in use while engaging paired garments, e.g., socks having respectively thinner and thicker cross sections.

In describing the invention the term "proximal" refers to the center portion of the clamp; "distal" refers to the end portions and "medial" refers to the portions between the center portion and the end portions, as the clamp appears while elongated as in FIGS. 2–5 and 9–12. The term "interior" refers to the portions facing one another (inwardly) while the clamp is in the clamped or closed position as in FIGS. 1 and 6–8. The term "exterior" refers to those portions located outwardly when the clamp is in the closed position.

As will be apparent from FIGS. 1 and 3, the garment(s) 19 sought to be clamped are placed between the interior distal, nonpenetrating substantially flat gripping surfaces 11 of the clamp 10. In folding the clamp over so that the then opposed interior gripping surfaces 11 will grasp the paired garments therebetween, the clamp 10 folds at proximal, flexible hinge portion 12, of lesser thickness than said medial and distal portions of the clamp, permitting the medial male portion having the toothed male locking member 13 to occupy a space in its corresponding medial female portion having the female locking cavity 15 with the teeth 14 on the male locking member occupying varying positions on the locking ledge(s) 16, as shown in the right-hand portion of the female locking cavity in FIG. 4. It will be observed that the position of the male locking member and the female locking cavity are so located as to avoid damaging the material being clamped. The exact tooth 14 of the male locking member 13 selected to mesh with the locking ledge(s) 16 will depend upon the thickness of the paired garments 19 being clamped, note FIGS. 6 and 7 in this regard, and the desired gripping strength utilized. This can be varied by application of different pressures in pushing the male locking member 13 into position on said ledge(s) 16. While only one ledge 16 has been shown, it will be apparent that a plurality of such ledges can be employed in accordance with this invention.

The locking member 13 is further secured in its clamped position by means of one or more medial male guides 17 which can be arranged in generally parallel position to one another and to the outer surfaces of male locking member 13. Male guides 17, upon closure of the clamp, fit within one or more medial mating female guide channels 18 located opposite to the male guides when the clamp is closed. While a pair of male guides 17 and mating female guide channels 18 have been illustrated; it should be apparent that only such guide and channel, or more than two can be employed.

It should be apparent from FIGS. 1, 3, 6, 7 and 8 that while the paired garments are being retained in the clamped position, no portion of the fabric or garments 19 is either penetrated by a portion of the clamp or placed in a stretched position by the clamp. As will be apparent from FIGS. 4, 6, 7, 9 and 10; an integral spur or pawl 20 is provided extending into cavity 15 with the dual purpose of initially guiding the curved leading portion of the non-toothed surface of the male locking member into engagement with the ledge 16 of the female locking cavity upon closure of the clamp and then retaining said male locking member in position with said ledge(s).

To unlock the clamp, one simply applies pressure to the upper portion of the male locking member causing its rearward surface to press against spur 20 permitting the teeth of the male locking member to disengage the ledge(s) thus allowing the withdrawal of the male locking member from the female locking cavity. This pressure can be finger pressure applied with the tip of the thumb, for example.

Figure 9:
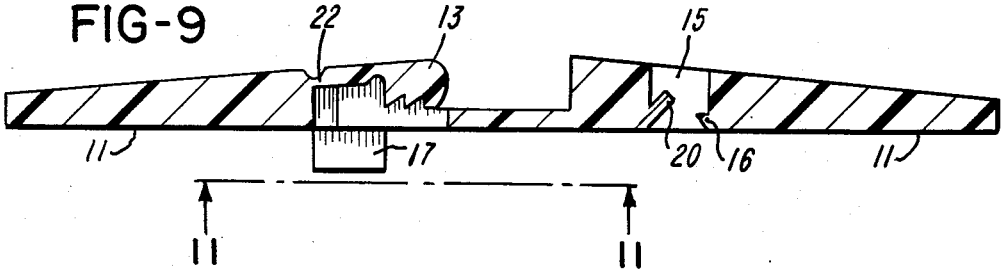
FIG. 9 is a cross-sectional view of an alternative embodiment for the clamp of this invention wherein the male locking member is formed as an integral extension on the upper surface of clamp 10.
Figure 10:
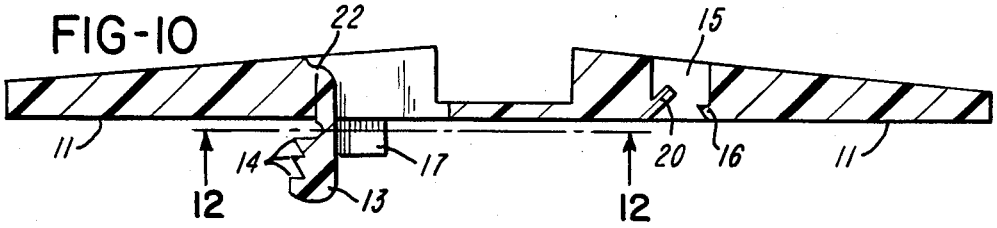
FIG. 10 is a cross-sectional view of the embodiment as in FIG. 9 wherein the male locking member has been depressed downwardly so as to be in a ready position for activating its teeth 14 to engage with the locking ledge 16 in the female locking cavity 15.

It will be apparent from FIGS. 9 and 10 that the male locking member 13 can be provided with a neck portion 22 which is of lesser thickness compared with its main body portion. This permits the male locking member to flex readily at the neck portion for positioning in the lock or clamped position and aids in unlocking it.

While the clamp of the present invention is a single piece, unitary molded configuration, the initial configuration and position of the male locking member 13, viz., prior to its first clamping use and placement in the locked position, can be of alternative construction or configuration.

Figure 7:
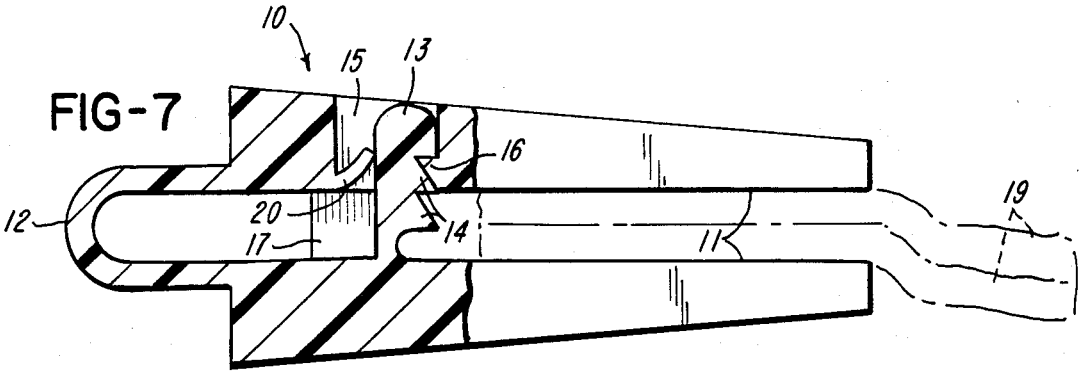

One embodiment is that shown in FIGS. 4, 6 and 7. This embodiment illustrates the clamp molded so as to have the male locking member integrally positioned on the interior side of clamp 10 substantially perpendicular to the gripping surfaces 11.

Figure 11:
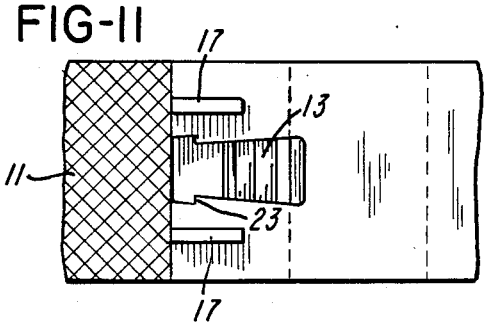
FIG. 11 is a sectional view of FIG. 9 taken along the lines 11—11 and illustrates the bottom side of the FIG. 9 embodiment for clamp 10 with the male locking member 13 presented as an integral extension of the upper side of the clamp 10, viz., prior to being downwardly depressed into position for use.
Figure 12:
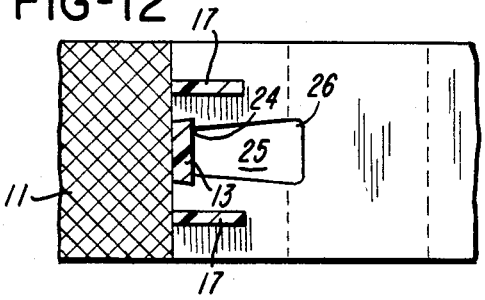
FIG. 12 is a sectional view along the lines 12—12 of FIG. 10 showing male locking number 13 downwardly depressed and ready for use.

An alternative embodiment of the clamp of the present invention is that illustrated in FIGS. 9 through 12 wherein the male locking member 13, as initially manufactured, occupies a position where its non-toothed side is an integral extension on the exterior surface as shown in FIGS. 9 through 11 of the clamp, viz., on the same side as the curved portion of neck 22 as shown in FIG. 9. When this embodiment is first used, one simply depresses or pushes the male locking member 13 downwardly from its position as illustrated in FIG. 9 to that of FIG. 10. The male locking member tooth portion 14, then pivots downwardly about its neck portion 22 into the fixed position shown in FIG. 10. One or more notches 23 are provided at the narrow portion 24 (FIGS. 11 and 12) of opening 25 to keep the male locking member in its fixed position for use in clamping garments. It will be observed that as the male locking member is downwardly depressed into its fixed position, it travels from the wider portion 26 of opening 25 into the narrow portion 24 thereof. In this embodiment male locking member 13 (FIG. 11) is provided with a tapered shape with the wider portion of the taper facing proximally toward the hinge and its narrower portion facing distally toward the gripping surfaces. This opening 25 serves as a channel adjacent to the male locking member to guide the male locking member into its fixed position and retain it upon meeting the notch(es) 23. This clamp configuration and embodiment illustrated in FIGS. 9 through 12 permits the use of a two piece mold to manufacture the clamp 10 whereas a three (or more) piece mold is required to manufacture the embodiment illustrated in FIGS. 3, 4, 6 and 7.

Figure 8:
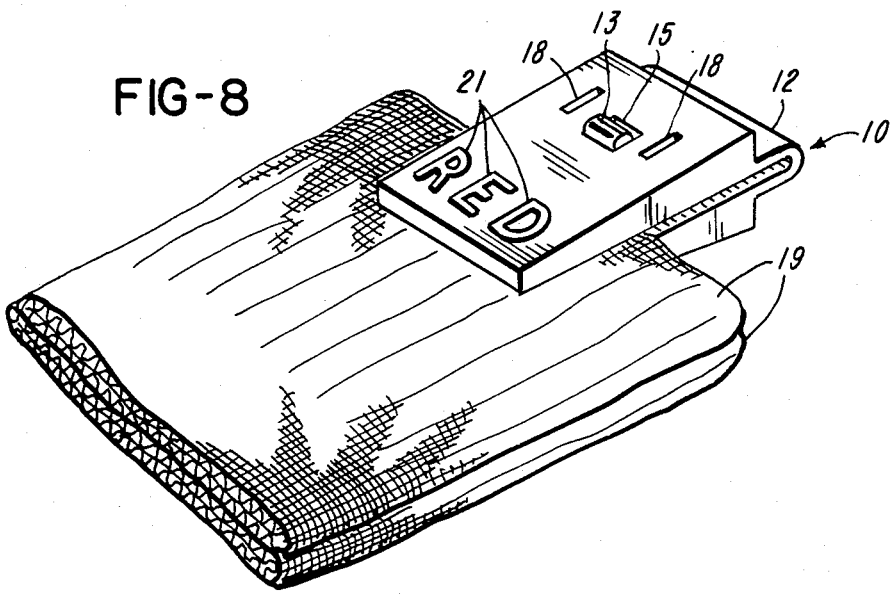
FIG. 8 is a perspective view of the clamp of this invention engaging a pair of matched garments wherein indicia has been applied to one or more outer surfaces of the clamp.

As will be noted in FIG. 8, indicia, which may be in an embossed, raised or depressed position from the outer surface(s) of clamp 10, can be provided to serve as an indicator of ownership, color or other feature(s) of the socks, hosiery, or other paired or unpaired garment(s) being clamped. This is of assistance to those persons having visual disabilities or impairment.

As will be apparent from FIGS. 6 and 7, the various positions afforded by the toothed portions of the male locking member meshing with the ledge(s) 16 in the female locking cavity permit use of the clamp of this invention with paired garments of different thicknesses. Also these various settings for the clamped position permit the use of lesser or stronger clamping forces, all without penetrating, stretching or otherwise damaging the garments being retained in place within the gripping surfaces 11.

As illustrated in FIG. 3 and other figures in the drawings, the gripping surfaces 11 can be scored, knurled or have other embossments which assist in gripping, but not penetrating the retained fabric 19.

The unitary, one-piece, molded clamp 10 of the present invention can be readily manufactured using a two or three piece mold by known injection and other molding techniques using inexpensive rubber and plastics materials. Suitable materials from which clamp 10 can be made include, but are not necessarily limited to, the following: polybutadiene rubbers, butadiene-styrene rubbers, butadiene-acrylonitrile rubbers, polyethylene, polypropylene, ethylene-propylene copolymers, etc. The use of propylene-containing polymers, e.g., polypropylene, ethylene-propylene copolymer materials, contributes longevity to the hinge feature of the clamp of this invention.

I claim:

1. A one piece adjustable clamping device for paired or matching articles of clothing comprising (A) A proximal, flexible hinge portion of lesser thickness than medial and distal portions;

(B) distal portions having interior, non-penetrating substantially flat gripping surfaces; and (C) male and female medial portions, said male medial portion having a male locking member one surface of which is toothed and the other surface of which is non-toothed and said female medial portion having a female locking cavity and a locking ledge(s) extending therein, wherein said toothed surface of said male locking member meshes with said locking ledge(s); said male medial portion includes a male guide(s) and said female medial portion includes a female guide channel(s) for receiving said guide(s) and a spur to guide the non-toothed surface of said male locking member into position in said female cavity and retain it.

2. A clamping device as in claim 1 wherein said male locking member has a neck portion of lesser thickness permitting it to flex for positioning in the lock position.

3. A clamping device as in claim 1 wherein said male locking member is tapered with its wider portion facing proximally and its narrower portion facing distally.

4. A clamping device as in claim 3 wherein said male medial portion has a tapered channel adjacent to said male locking member, said channel having a notch(es) in its distally facing narrower portion whereby said tapered channel guides said male locking member into a fixed position and said notch(es) assist(s) in retaining it.

5. A clamping device as in claim 1 wherein said male locking member is tapered with its wider portion facing proximally, its narrower portion facing distally and has a neck portion of lesser thickness permitting it to flex for positioning in the lock position.

6. A clamping device as in claim 1 wherein said clamp is a polypropylene-containing polymer material.

7. A clamping device as in claim 1 wherein an exterior surface(s) of said distal portion(s) contain(s) indicia.

8. A clamping device as in claim 5 wherein said male medial portion has a tapered channel adjacent to said male locking member, said channel having a notch(es) in its distally facing narrower portion whereby said tapered channel guides said male locking member into a fixed position and said notch(es) assist(s) in retaining it.

* * * * *